US008944427B2

(12) United States Patent
Habib Jiwan et al.

(10) Patent No.: US 8,944,427 B2
(45) Date of Patent: Feb. 3, 2015

(54) SUPPLY DEVICE FOR A MACHINE FOR TRANSVERSELY CUTTING AT LEAST ONE STRIP OF FLEXIBLE MATERIAL

(75) Inventors: Christian Habib Jiwan, Turckheim (FR); Christophe Picoulet, Bergholtz (FR); Robert Pointurier, Colmar (FR)

(73) Assignee: Kern A. G., Konolfingen (CH)

( * ) Notice: Subject to any disclaimer, the term of this patent is extended or adjusted under 35 U.S.C. 154(b) by 5 days.

(21) Appl. No.: 13/697,168

(22) PCT Filed: Apr. 28, 2011

(86) PCT No.: PCT/FR2011/000260
§ 371 (c)(1),
(2), (4) Date: Nov. 9, 2012

(87) PCT Pub. No.: WO2011/144822
PCT Pub. Date: Nov. 24, 2011

(65) Prior Publication Data

US 2013/0062389 A1 Mar. 14, 2013

(30) Foreign Application Priority Data

May 17, 2010 (FR) ..... 10 53787

(51) Int. Cl.
*B65H 35/04* (2006.01)
*B65H 20/02* (2006.01)

(52) U.S. Cl.
CPC ..... *B65H 35/04* (2013.01); *B65H 20/02* (2013.01); *B65H 2301/4219* (2013.01); *B65H 2404/1424* (2013.01); *B65H 2701/1864* (2013.01)
USPC ..... 270/52.17; 270/52.09; 270/21.1; 270/52.02; 266/19; 266/15; 414/791.2

(58) Field of Classification Search
CPC ..... B65H 35/04; B65H 23/02; B65H 23/038; B65H 39/16
USPC ..... 270/52.02, 21.1, 30.08, 52.09, 52.17; 226/15, 18, 19; 414/791.2
See application file for complete search history.

(56) References Cited

U.S. PATENT DOCUMENTS 2,214,593 A * 9/1940 Pittaluga et al. ..... 83/29
3,467,292 A * 9/1969 Alexeff et al. ..... 226/19
(Continued)

FOREIGN PATENT DOCUMENTS

DE 35 33 275 A1 3/1987

OTHER PUBLICATIONS

French Search Report Corresponding to FR10/53787.
(Continued)

*Primary Examiner* — Patrick Mackey
(74) *Attorney, Agent, or Firm* — Davis & Bujold, PLLC; Michael J. Bujold

(57) ABSTRACT

A supply device (10) for a machine for transversely cutting two strips (11 and 12) of a flexible material, in particular a strip of paper, moving continuously, to produce separate stacks of documents cut transversely according to predetermined formats. The device comprises lower and upper driving mechanisms (13, 14) associated with the two strips (11, 12) of flexible material respectively, which each include a mechanically rotated first roller (13*a*, 14*a*) and a freely rotatable second bearing roller (13*b* and 14*b*). The driving mechanism is mounted on a frame (15) supported by a movable platform (16) which is rigidly connected to a linear actuator (17) arranged to be moved transversely with respect to the direction of movement of the strips (11 and 12). Optical reading cells (11*a*, 11*b*, 12*a*, 12*b*) define the operating modes of the driving servomotors (13*b* and 14*b*) and of the linear actuator (17).

10 Claims, 3 Drawing Sheets

(56) References Cited

U.S. PATENT DOCUMENTS

| | | | | |
|---|---|---|---|---|
| 4,091,978 | A * | 5/1978 | Graham, II | 225/100 |
| 4,437,918 | A * | 3/1984 | Morohashi et al. | 156/322 |
| 4,939,888 | A * | 7/1990 | Katz et al. | 53/411 |
| 7,197,971 | B2 * | 4/2007 | Trovinger | 83/256 |
| 7,523,925 | B2 * | 4/2009 | Herbert et al. | 270/5.02 |
| 7,961,299 | B2 * | 6/2011 | Sato et al. | 355/72 |
| 8,291,798 | B2 * | 10/2012 | Schafer et al. | 83/86 |
| 2003/0164103 | A1 * | 9/2003 | Lamothe | 101/227 |
| 2004/0028448 | A1 * | 2/2004 | Seiler et al. | 400/621 |
| 2010/0072244 | A1 * | 3/2010 | Chuang et al. | 226/19 |

OTHER PUBLICATIONS

International Search Report Corresponding to PCT/FR2011/000260.
Written Opinion Corresponding to PCT/FR2011/000260.

* cited by examiner

SUPPLY DEVICE FOR A MACHINE FOR TRANSVERSELY CUTTING AT LEAST ONE STRIP OF FLEXIBLE MATERIAL

This application is a National Stage completion of PCT/FR2011/000260 filed Apr. 28, 2011, which claims priority from French patent application serial no. 10/53787 filed May 17, 2010.

FIELD OF THE INVENTION

The present invention relates to a supply device for a machine for transversely cutting at least one strip of a flexible material, in particular a strip of paper, moving continuously, to produce separate stacks of documents cut transversely according to determined formats and to shift these stacks sideways with respect to each other in order to identify them, this device comprising at least one driving means associated with said strip of flexible material including at least one first roller which is mechanically rotated and a second bearing roller which is freely rotatable around its axis.

BACKGROUND OF THE INVENTION

Today, in the sheets cutting and grouping line of a unit for processing documents on paper or similar materials, the operations consisting in grouping sheets by stacking are carried out by specific modules that intervene either after the transverse cutting of the sheets in continuous strips, or before this cutting. The function of all these modules is to put together in one single stack several sheets cut side by side in parallel or superimposed strips.

In the case where the assembling module is located downstream with respect to the transverse cutting unit, the processing line must obligatorily have a great length, since it must group progressively on one single track two sheets located initially on two parallel tracks. Actually, the lateral shift can only take place progressively because of the relatively quick longitudinal displacement of the sheets and of a comparatively slower lateral displacement. In addition, these modules are mechanically complicated and cumbersome.

In the case where the assembling module is located before the transverse cutting machine, it would be necessary to shift laterally the superimposed strips before performing the cut, which is at the moment impossible to carry out.

Similarly, it is advantageous to have the possibility to define a feeding priority for one or the other flexible material strip on which are printed for example documents, towards the cutting machine. This chronology allows starting to form the stacks in a predetermined way, these stacks being for example made of a defined number of sheets with an even numbering or of sheets with an odd numbering. It is necessary to have the possibility both to move the paper strips laterally, and to present them for cutting, positioning in priority the one or the other strip or both simultaneously, according to the stack configurations to be produced.

There is today no efficient solution to solve the problem of the sorting and positioning of the sheets cut out of continuous material strips, these operations taking place on a device that is simple and of small size.

SUMMARY OF THE INVENTION

The present invention aims to solve this problem by realising a supply device for a sheets cutting machine, in particular sheets out of paper or a similar material, on which documents are printed by one or several printers supplied with continuous strips from paper rolls, these sheets being cut transversely and then placed on separate stacks or simply shifted, each stack being identifiable with respect to the previous and the following one thanks to this separation or this shift.

To that purpose, the device of the invention, as defined in the preamble, is characterised in that it comprises at least one linear actuator arranged to support said driving means of said flexible material strip to be cut, and to shift laterally and selectively said flexible material strip upstream of said transverse cutting machine in order to form said document stacks.

For a transverse cutting machine in which several continuously moving flexible materiel strips are processed approximately simultaneously, a specific driving means comprising a first roller which is mechanically rotated and a second bearing roller which is freely rotatable around its axis is preferably associated with each of said flexible material strips. In this case, the device includes advantageously at least one linear actuator arranged to move laterally and selectively at least one flexible material strip upstream of said cutting machine, transversely with respect to the direction of movement of the flexible material strip in order to form said distinct document stacks.

Preferably, said driving means is mounted on a frame supported by a movable platform rigidly connected to said linear actuator, which is arranged so as to be moved transversally with respect to the direction of movement of the flexible material strip.

When the device includes at least two driving means associated respectively with at least two flexible material strips, the two driving means are advantageously arranged over one another on the same frame supported by said movable platform rigidly connected to said linear actuator, which is arranged so as to move simultaneously the flexible material strips transversely with respect to their direction of movement.

Said linear actuator comprises preferably a jack coupled to said platform, this jack can be pneumatic, hydraulic or actuated by an electrical motor.

According to a preferred embodiment, the device comprises detection means associated with each continuously moving flexible material strip, these means including at least one cell for reading at least one code containing information relating to the cutting format and/or to the lateral positioning of the documents to be cut.

Said detection means comprise advantageously at least two reading cells for each of the flexible material strips, one of these cells being arranged to determine the format of the document to be cut and the other to give, if necessary, a signal for the lateral shift of the concerned flexible material strip.

In a particularly advantageous way, said code is an optically readable code.

According to an advantageous embodiment, said linear actuator is arranged so as to have several degrees of lateral movement, each of these degrees corresponding to an amount of shift of a cut documents stack.

According to a preferred embodiment, said code contains information that triggers a priority signal defining which one of the strips is to be fed in priority to the cutting machine.

BRIEF DESCRIPTION OF THE DRAWINGS

The present invention and its advantages will be better revealed in the following description of an embodiment given as a non limiting example, in reference to the drawings in appendix, in which.

DETAILED DESCRIPTION OF THE PREFERRED EMBODIMENTS

Figure 1:
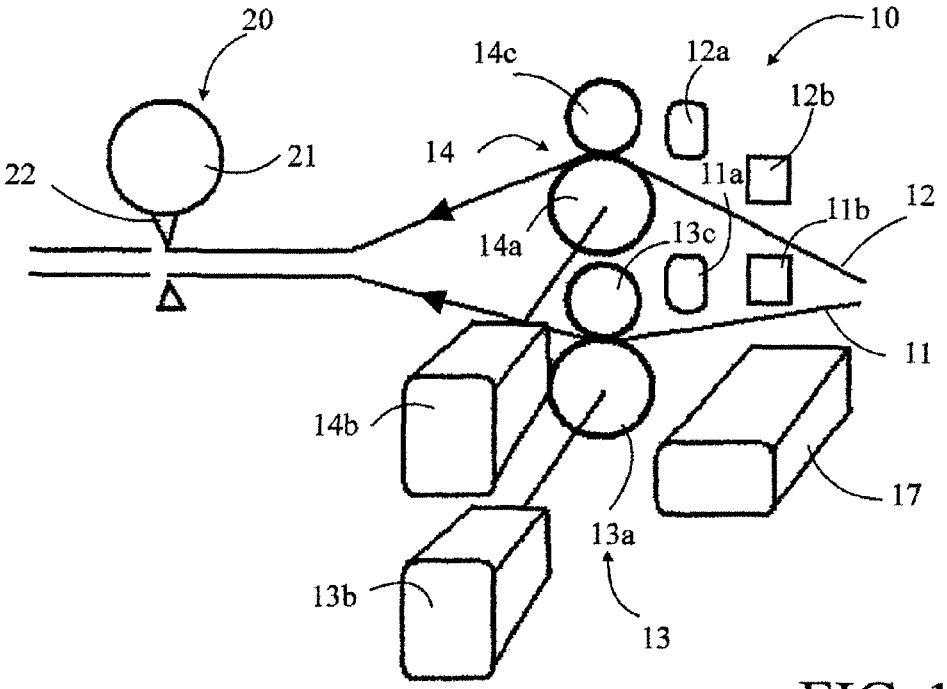
FIG. 1 represents a side view of the principle that illustrates the construction and the operating mode of an embodiment of the device of the invention.
Figure 2:
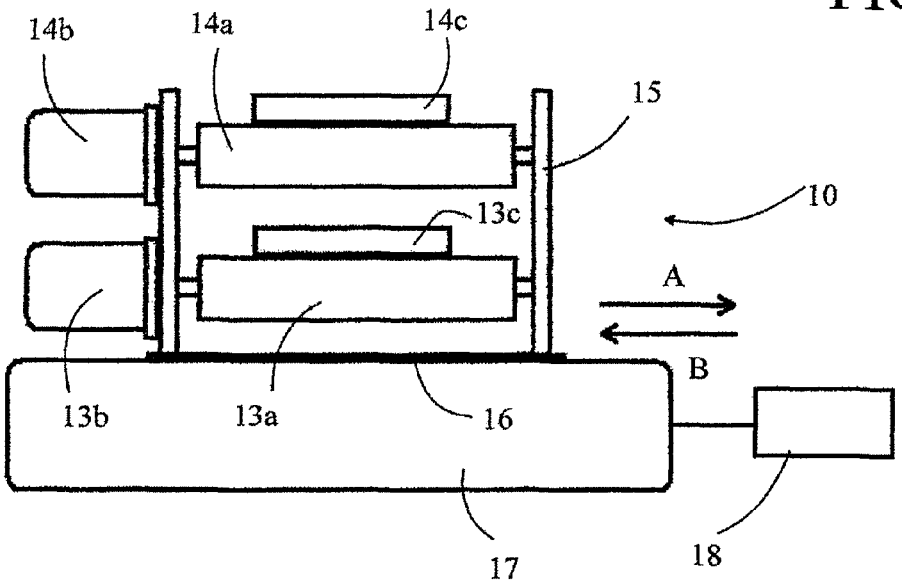
FIG. 2 is a schematic front view of the embodiment of the device as shown in FIG. 1.

Referring to FIG. 1, the supply device 10 comprises in this case two transport circuits for the flexible material to be cut, in this case two strips out of paper or a similar material, called from now on lower strip 11 and upper strip 12, on which have been printed for example documents that are to be cut in sheets and then grouped in stacks separated from each other so as to allow identifying them. To transport the paper strips, the device is equipped with individual driving means associated with the respective strips.

In the present case, lower strip 11 is associated with a lower driving means 13 and upper strip 12 is associated with an upper driving means 14. The lower driving means 13 comprises a first roller 13*a* called driving roller, actuated mechanically by a servomotor 13*b* and a second roller 13*c* called bearing roller that turns freely around its axis. The upper driving means 14 comprises a first roller 14*a*, called driving roller, actuated mechanically by a servomotor 14*b* and a second roller 14*c*, called bearing roller that turns freely around its axis. Said lower driving means 13 and said upper driving means 14 are mounted on a frame 15 supported by a movable platform 16 rigidly connected to a linear actuator 17 arranged to be moved transversally with respect to the direction of movement of strips 11 and 12, according to arrows A and B. The linear actuator can for example comprise a pneumatic jack 18 or any other element liable to move platform 16.

These movements are controlled by a central control unit (not represented) that receives signals transmitted by various sensors located along the transport circuits of strips 11 and 12. A first cell 11*a*, which detects the entering edge of lower strip 11, and a second cell 11*b*, which detects marks intended for being interpreted by the central control unit in order to control the various moving elements, that is to say servomotor 13*b* and/or linear actuator 17 and move longitudinally and/or laterally the corresponding strip 11 are arranged along lower strip 11. These marks advantageously also include an information that defines the priority for the supply of one or of the other strip, or of both strips simultaneously, to the cutting machine. Similarly, a first cell 12*a*, which detects the entering edge of upper strip 12, and a second cell 12*b*, which detects marks intended for being interpreted by the central control unit in order to control the various moving elements, that is to say servomotor 14*b* and/or linear actuator 17 and move longitudinally and/or laterally the corresponding strip 12 are arranged along lower strip 12.

After these components, downstream of the supply device 10, is located a cutting machine 20 represented schematically by a rotating drum 21 equipped with a knife 22 intended for cutting the strips in sheets, transversely with respect to the direction of movement of these strips. The cutting machine is a classical machine, known per se, and the rotating drum with its rotating knife could also be replaced with a guillotine cutting device or by any other known means.

Figure 3:
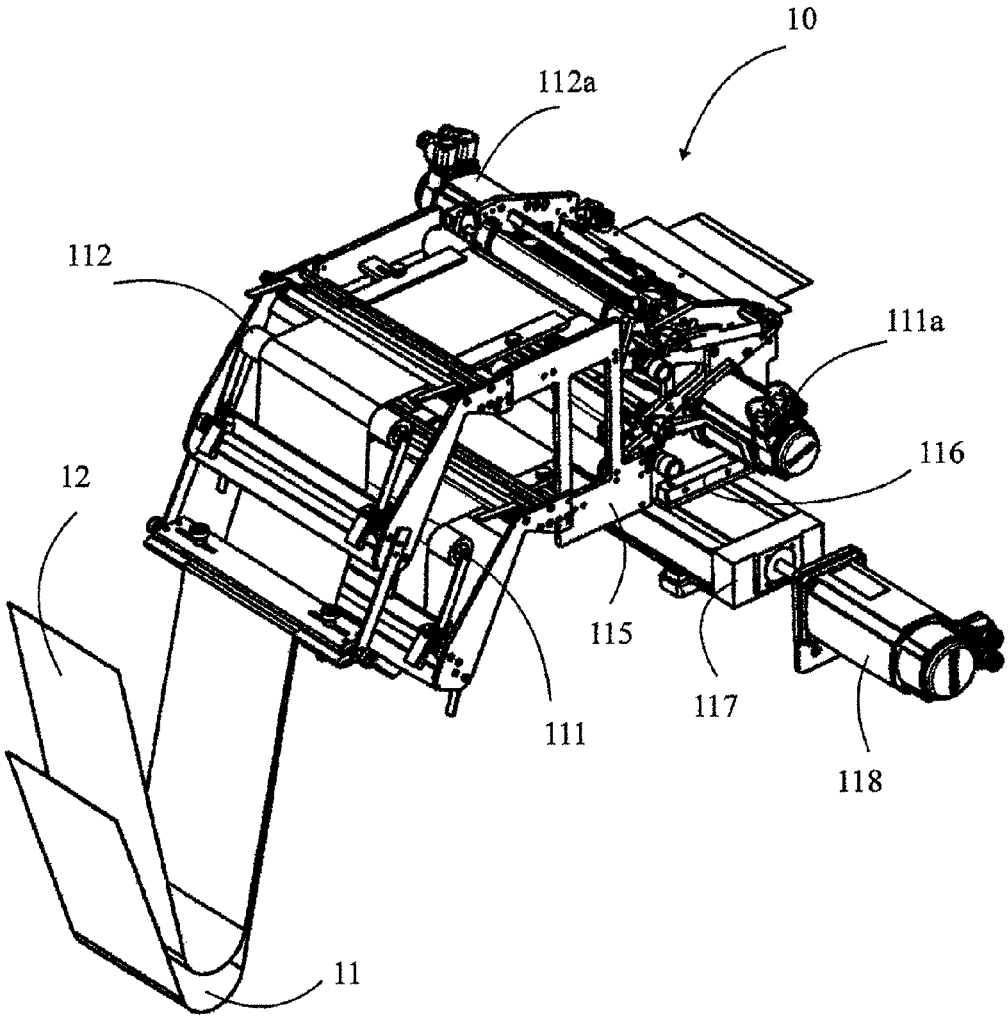
FIG. 3 represents a perspective view that illustrates the supply device according to the invention in an embodiment operating with two flexible material strips.

FIG. 3 represents a perspective view of a device according to the invention, built to operate with two paper strips at the inlet of the line, which is followed by a transverse cutting machine (not represented). It mainly includes a frame 110 that carries a first inlet roller 111, which guides lower strip 11, and a second upper roller 112, which guides upper strip 12. One will note that the two flexible material strips 11 and 12 to be cut form loops at the inlet of the device. These loops serve for creating reserves so as to allow adjustable-speed drives or even sequential drives in the device and up to the cutting machine, while the documents are continuously printed. Frame 115 supports the movable platform 116 supported by actuator 117 associated with a pneumatic jack 118 or similar. Actuator 117 can be a ball carriage or similar. Platform 116 supports the driving means associated with lower strip 11 and the driving means associated with upper strip 12 respectively with servomotor 111*a* and servomotor 112*a*. One notes that this construction is extremely compact and does not lead to overlengths between the inlet of strips 11 and 12 and their outlet towards the cutting machine.

Figure 4:
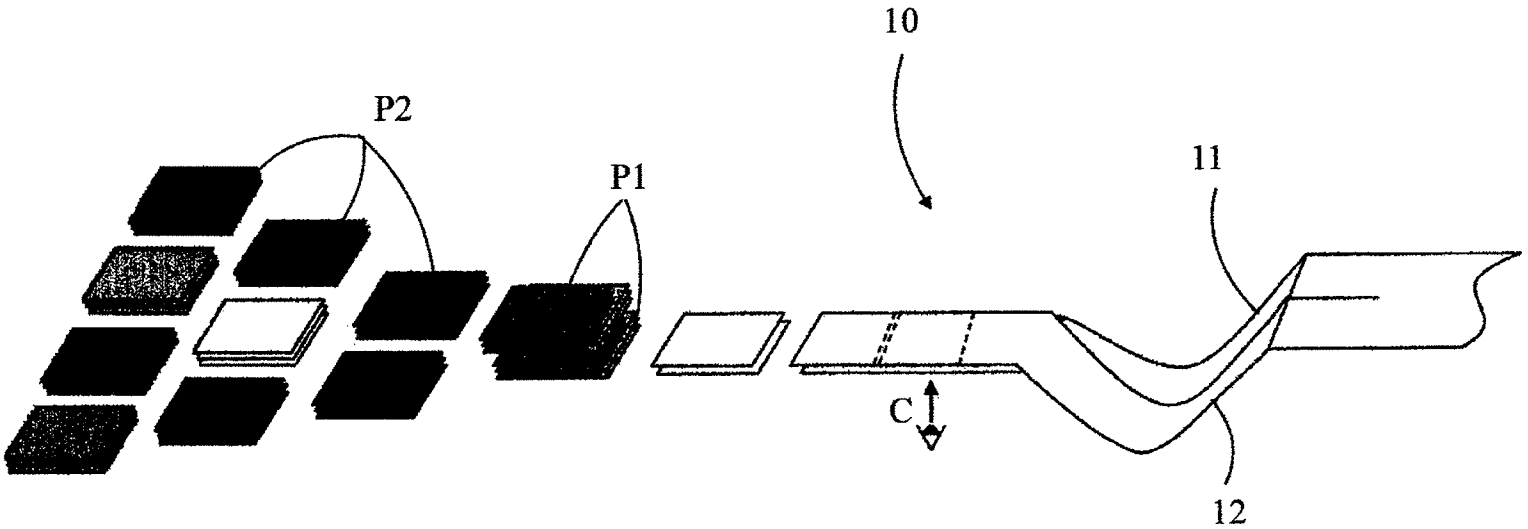
FIG. 4 represents a view that illustrates schematically the displacement of the two flexible material strips and the stacks that can be produced thanks to the device of the invention.

FIG. 4 is a schematic view that illustrates the displacement of the flexible material strips 11 and 12, and the stack arrangements that can be achieved after cutting thanks to the described supply device. Two superimposed paper strips 11 and 12 are transported to the inlet of device 10 and, according to the read-out of the codes, shifted sequentially according to the longitudinal direction or laterally according to a transverse direction, as shown by double arrow C, and then brought to the cutting machine. The cutting machine produces individual sheets in the predetermined format in compliance with the read-out of codes carried by the strips and read by the cells. The strips are introduced sequentially, superimposed or shifted, depending on whether the linear actuator moves them or not and whether the servomotors accelerate them or slow them down. It is thus possible to produce shifted superimposed stacks P1, or juxtaposed stacks P2.

In operation, the device 10 allows operating as follows. A large roll of paper is initially divided in two strips by means of a longitudinal cutting system arranged upstream of device 10. Each of the two strips is transported towards its driving means. The first cells are intended respectively for detecting the initial edge of each of the strips in order to synchronise the displacement of the corresponding strip with the cutting machine, which allows determining the format of the sheet that will be cut. The second cells located close to the first ones are intended for reading a code or a mark giving the following information:

- Which of the two strips, respectively the upper of the lower one, is transported in priority towards the cutting machine.
- If necessary, whether both strips are to be transported simultaneously to the cutting machine.
- Whether the driving means of the two strips including the driving rollers and the free bearing rollers, as well as the servomotors, are to be shifted laterally in order to separate packs of sheets for their identification. This shift is caused by the activation of the linear actuator.

The operations above result in the following successive work sequences:

- When one or the other paper strip is transported towards the cutting machine, the driving rollers are put in motion by the servomotors that drive them. When the initial edge of the paper strip is read by the corresponding cell, a signal is sent to the appropriate servomotor to position the paper so that the cutting machine cuts the sheet exactly at the format requested when starting up the device.

The same will apply to the consecutive formats that will be determined by reading a mark placed on the paper strip, this reading being preferably optical.

A second mark is read by the second cell, which has the function of determining which of the strips of paper or of another flexible material, depending on the nature of the rollers of material originally introduced in the processing line the supply device belongs to, is transported first towards the cutting machine, knowing that both can also be transported in the same time. This operation will allow forming paper stacks whose number can be either even or odd, independently of the choice of the strip cut in priority.

The second function of the optical mark appearing on the paper strip read by the second cell is the control of the shift of the driving rollers by means of the linear actuator. Forming shifted sheet stacks allows easier identification of the stacks and their taking in charge by operators.

When reading a mark that controls the lateral shift, the signal triggered by this reading controls the linear actuator in order to move the strips transversely, and controls the slowing down of the driving rollers in order to allow the lateral shift to be carried out accurately. A time set point value then allows the moving components of the device to reach again their normal speed until a similar sequence is triggered again following the reading of a mark placed on the strips out of a flexible material, or similar.

The device of the invention is not restricted to this embodiment as it is described. The number of rolls of flexible material can be higher than two, or even limited to only one. The shifts could be multiplied, that is to say that one could envisage producing stacks shifted at different degrees so as to identify a larger number of stacks. The construction of the device nevertheless remains compact and its control easy, since the operations of each of the sequences are performed quickly and without complications. In case of multiple strips, all of the strips or only one or several of them can be associated with one or several linear actuators arranged to move laterally one or several strips. The driving servomotors of each of the strips are able to accelerate or slow down the corresponding strip in order to define the feeding priorities of each strip to the cutting machine. These speed modulations are controlled by the cells reading the codes containing the suitable information.

The invention claimed is:

1. A supply device (10) for a machine (20) for transversely cutting at least one strip of flexible material (11, 12) moving continuously, to produce separate stacks of documents cut transversely according to determined formats and for shifting the stacks of documents laterally with respect to one another in order to identify the stacks of documents, the device comprising at least one driving means (13, 14) associated with the strip of flexible material including at least one driving roller (13*a*, 14*a*) which is mechanically rotated and a bearing roller (13*c*, 14*c*) which is freely rotatable around an axis, the device comprising at least one linear actuator (17) arranged to support the driving means (13, 14) of the strip of flexible material (11, 12) to be cut, and to shift laterally and selectively the strip of flexible material upstream of the transverse cutting machine (20) in order to form distinct document stacks, and the device comprises detection means associated with each of the continuously moving flexible material strips (11, 12), each of the detection means including at least one cell (11*a*, 11*b*, 12*a*, 12*b*) for reading at least one code containing information relating to at least one of a cutting format and a lateral positioning of the documents cut.

2. The supply device for the transverse cutting machine according to claim 1, in which several continuously moving strips of the flexible material (11, 12) are processed approximately simultaneously, wherein each of the driving means (13, 14) comprising a drive roller (13*a*, 14*a*) driven mechanically in rotation and a bearing roller (13*c*, 14*c*) that turns freely around the axis is associated with each of the flexible material strips, and the device includes at least the linear actuator (17) arranged to move laterally and selectively at least the flexible material strip upstream of the cutting machine (20), transversely with respect to a direction of movement of the flexible material strip in order to form the distinct document stacks.

3. The supply device for the transverse cutting machine according to claim 1, wherein the driving means (13, 14) is mounted on a frame (15) supported by a movable platform (16) rigidly connected to the linear actuator (17), arranged so as to be moved transversely with respect to a direction of movement of the flexible material strip (11 or 12).

4. The supply device for the transverse cutting machine according to claim 3, wherein the linear actuator (17) comprises a jack coupled to the platform (16).

5. The supply device for a transverse cutting machine according to claim 1, wherein the detection means comprise at least two reading cells (11*a*, 11*b*; 12*a*, 12*b*) for each of the flexible material strips (11, 12), and a first of the at least two reading cells is arranged to determine the cutting format of the document to be cut and a second of the at least two reading cells is arranged to provide a signal relating to the lateral shift of the concerned strip of flexible material.

6. The supply device for the transverse cutting machine according to claim 1, wherein the code is an optically readable code.

7. The supply device for the transverse cutting machine according to claim 1, wherein the linear actuator (17) is arranged so as to have several degrees of lateral movement, and each of the degrees of lateral movement corresponds to an amount of shift of a cut document stack.

8. The supply device for the transverse cutting machine according to claim 1, wherein the code contains information that triggers a priority signal that defines an order in which one of the flexible material strips (11 or 12) is to be fed to the cutting machine (20).

9. A supply device (10) for a machine (20) for transversely cutting at least one strip of continuously moving flexible paper (11, 12) to produce separate distinct stacks of documents, the at least one strip of flexible paper being cut transversely according to determined formats and for shifting the distinct stacks of documents laterally with respect to one another in order to identify the distinct stacks of documents, the device comprising at least one driving mechanism (13, 14) associated with the at least one strip of flexible paper and including at least one drive roller (13*a*, 14*a*) which is mechanically rotated and a bearing roller (13*c*, 14*c*) which is freely rotatable around an axis, the device comprising at least one linear actuator (17) which supports the at least one driving mechanism (13, 14) of the at least one strip of flexible paper (11, 12) to be cut, and which laterally and selectively shifts the at least one strip of flexible paper upstream of the transverse cutting machine (20) in order to form the distinct stacks of documents, and the device comprising detection means associated with each of the continuously moving flexible material strips (11, 12), each of the detection means including at least one cell (11*a*, 11*b*, 12*a*, 12*b*) for reading at least one code containing information relating to at least one of a cutting format and a lateral positioning of the documents cut.

10. A supply device (10) for a machine (20) for transversely cutting at least a strip of a flexible material (11, 12) moving continuously, to produce separate stacks of documents cut transversely according to determined formats and for shifting the stacks of documents laterally with respect to one another in order to identify the stacks of documents;

the device comprising at least a driving means (13, 14) associated with the strip of flexible material including at least a drive roller (13*a*, 14*a*) which is mechanically rotated and a bearing roller (13*c*, 14*c*) which is freely rotatable around an axis;

the device comprising at least a linear actuator (17) arranged to support the driving means (13, 14) of the flexible material strip (11, 12) to be cut, and to shift laterally and selectively the flexible material strip upstream of the transverse cutting machine (20) in order to form distinct document stacks;

wherein the driving means (13, 14) is mounted on a frame (15) supported by a movable platform (16) rigidly connected to the linear actuator (17) and arranged so as to be moved transversely with respect to a direction of movement of the flexible material strip (11 or 12); and at least two driving means associated respectively with at least two flexible material strips (11 and 12), and the two driving means are arranged over one another on the frame (15) supported by the movable platform (16) rigidly connected to the linear actuator (17), and arranged so as to move simultaneously the flexible material strips (11 and 12) transversely with respect to their direction of movement.

* * * * *